US007081018B2

(12) United States Patent
Nagaoka et al.

(10) Patent No.: US 7,081,018 B2
(45) Date of Patent: Jul. 25, 2006

(54) STRUCTURE OF CONNECTING WIRE TO ELEMENT-CONTAINING UNIT

(75) Inventors: Yasutaka Nagaoka, Shizuoka (JP); Toru Yamaguchi, Shizuoka (JP); Seigen Maeno, Aichi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/242,022

(22) Filed: Oct. 4, 2005

(65) Prior Publication Data

US 2006/0073738 A1 Apr. 6, 2006

(30) Foreign Application Priority Data

Oct. 4, 2004 (JP) ..... P2004-291354

(51) Int. Cl.
*H01R 13/66* (2006.01)

(52) U.S. Cl. ..... 439/620; 333/182

(58) Field of Classification Search ..... 439/620; 333/181–184, 16
See application file for complete search history.

(56) References Cited

U.S. PATENT DOCUMENTS

| | | | | |
|---|---|---|---|---|
| 3,854,107 | A * | 12/1974 | Tuchto et al. | 333/183 |
| 4,581,596 | A * | 4/1986 | Dirmeyer et al. | 333/181 |
| 4,611,185 | A * | 9/1986 | Dirmeyer et al. | 333/167 |
| 4,760,357 | A * | 7/1988 | Yamaguchi | 333/181 |
| 5,475,347 | A * | 12/1995 | Kwak | 333/185 |
| 5,546,058 | A * | 8/1996 | Azuma et al. | 333/183 |
| 5,563,559 | A * | 10/1996 | Stephens et al. | 333/182 |
| 5,577,937 | A * | 11/1996 | Itoh et al. | 439/620 |
| 5,580,260 | A * | 12/1996 | Flieger et al. | 439/188 |
| 5,624,277 | A * | 4/1997 | Ward | 439/620 |
| 5,630,734 | A * | 5/1997 | Phillips, Jr. | 439/620 |
| 5,647,761 | A * | 7/1997 | Kaminski | 439/419 |
| 5,851,122 | A * | 12/1998 | Huber et al. | 439/620 |
| 5,982,253 | A * | 11/1999 | Perrin et al. | 333/182 |
| 6,364,712 | B1 * | 4/2002 | Durr et al. | 439/620 |
| 6,488,539 | B1 * | 12/2002 | Turek et al. | 439/620 |
| 6,517,384 | B1 * | 2/2003 | Murasawa et al. | 439/620 |
| 6,688,916 | B1 * | 2/2004 | Lee | 439/620 |
| 6,700,357 | B1 * | 3/2004 | Taniguchi | 322/99 |
| 6,743,052 | B1 * | 6/2004 | Lin et al. | 439/620 |
| 6,755,692 | B1 * | 6/2004 | Hsu | 439/620 |
| 6,790,091 | B1 * | 9/2004 | Palomaki et al. | 439/620 |
| 6,848,945 | B1 * | 2/2005 | Lecuppe et al. | 439/620 |
| 6,942,523 | B1 * | 9/2005 | Pavlovic et al. | 439/620 |
| 6,991,496 | B1 * | 1/2006 | Kuribayashi et al. | 439/620 |
| 2002/0006749 | A1 * | 1/2002 | Yamamoto et al. | 439/620 |
| 2002/0068485 | A1 * | 6/2002 | Busch et al. | 439/620 |
| 2003/0073349 | A1 * | 4/2003 | Nagao et al. | 439/620 |
| 2003/0227355 | A1 * | 12/2003 | Lindenberger | 333/182 |
| 2003/0228802 | A1 * | 12/2003 | Palagi et al. | 439/620 |
| 2005/0118874 | A1 * | 6/2005 | Lin | 439/620 |

FOREIGN PATENT DOCUMENTS

JP 2-295199 A 12/1990

* cited by examiner

*Primary Examiner*—Ross Gushi
(74) *Attorney, Agent, or Firm*—Sughrue Mion, PLLC

(57) ABSTRACT

An insulative internal resin cover is provided to partition an internal space of upper and lower insulative resin covers into a wire receiving space and an element receiving space. A wire-side terminal is provided at an intermediate portion of a wire, and is electrically connected to a conductor of the wire. When the intermediate portion of the wire is located in the wire receiving space, the wire-side terminal is inserted from the wire receiving space into the element receiving space through a terminal insertion hole formed in the internal resin cover, and is connected to a circuit including an element received in the element receiving space.

6 Claims, 3 Drawing Sheets

STRUCTURE OF CONNECTING WIRE TO ELEMENT-CONTAINING UNIT

BACKGROUND OF THE INVENTION

1 . Field of the Invention

This invention relates to a structure of connecting a wire to an element-containing unit having an element contained in an internal space of upper and lower insulative resin covers.

2 . Related Art

For example, there are occasions when transmission noises with a high-frequency component from a noise source such as a horn and a wiper motor, external noises from a neon glow lamp or the like, induction noises and the like are inputted through a wire into various sensors provided on an automobile. In such a case, there is encountered a problem that a wrong operation is caused by the inputted noises. It has heretofore been proposed to provide a noise prevention device (as disclosed in JP-A-2-295199 (Page 2, FIGS. 1 to 5)) at an intermediate portion of the wire.

The noise prevention device, disclosed in JP-A-2-295199, includes an upper resin cover and a lower resin cover which cooperate with each other to cover and receive intermediate portions of wires. Conducting portions are formed on the lower resin cover by plating. A press-contacting blade for being press-contacted with the intermediate portion of the wire is provided at one end of each conducting portion, and is formed on and projects from an inner bottom surface of the lower resin cover. A chip capacitor is mounted on an intermediate portion of each conducting portion. The chip capacitor is fixed by the plating forming the conducting portion. Namely, the chip capacitor is fixed when the plating is formed on the lower resin cover. The other end of the conducting portion is extended to an outer surface of the lower resin cover via a through hole formed through the lower resin cover. More specifically, the other end portion of the conducting portion is formed on an entire surface of a retaining clip formed on the outer surface of the lower resin cover. When the retaining clip is retainingly engaged with a vehicle body, the noise prevention device performs a grounding function via this vehicle body.

In the above conventional technique, when the intermediate portion of the wire, received in an internal space formed by the upper and lower resin covers, is not extended straight, there is a possibility that the following disadvantages are encountered. Namely, there is a possibility that the bent intermediate portion of the flexible wire interferes with the chip capacitor to damage the same, and in some cases there is a possibility that the chip capacitor is separated from the conducting portion. Therefore, it is necessary to beforehand straighten the intermediate portion of the wire which is to be received in the resin covers although this is cumbersome.

Moreover, the above conventional technique is directed to the structure in which the conducting portions are formed by applying the plating to the lower resin cover made of a resin, and therefore the production process requires many steps, which invites a problem that the efficiency of the production is very low. Furthermore, in this structure, the chip capacitors are fixed by applying the plating, and therefore there is a fear that the fixed condition of each capacitor becomes insufficient.

SUMMARY OF THE INVENTION

This invention has been made in view of the above circumstances, and an object of the invention is to provide a structure of connecting a wire to an element-containing unit, in which damage and the separation of an element are prevented. Another object is to provide a structure of connecting a wire to an element-containing unit, in which a production efficiency can be enhanced, and an element can be fixed sufficiently.

(1) The above object has been solved by a structure of connecting a wire to an element-containing unit comprising:

a wire; and an element-containing unit including:

upper and lower insulative resin covers for covering an intermediate portion of the wire and an element, one terminal of which is electrically connected to a conductor of the wire, and another terminal of which is electrically connected to a grounding terminal;

an insulative internal resin cover provided to partition an internal space of the upper and lower resin covers into a wire receiving space in which the intermediate portion is located and an element receiving space in which the element is received; and a wire-side terminal provided on the intermediate portion of the wire so as to be electrically connected to the conductor of the wire, wherein the wire-side terminal is extended to the element receiving space to electrically connected to a circuit including the element through a terminal insertion hole formed in the internal resin cover.

In the invention having the above features, the intermediate portion of the wire is received in the wire receiving space within the upper and lower resin covers, and only the wire-side terminal, connected to the received portion of the wire, is inserted into the element receiving space (where the element exists), and is connected to the circuit including the element. Thanks to the provision of the internal resin cover, the intermediate portion of the wire is prevented from contacting the element. In the invention, when the intermediate portion of the wire is covered by the upper and lower resin covers of the element-containing unit, the connection of the wire to the element-containing unit is completed, and therefore this connecting operation can be carried out almost as easily as in the conventional structure.

(2) A structure of connecting a wire to an element-containing unit of the invention may be characterized in that a relay terminal for connecting the wire-side terminal and the element to form the circuit and an element connection portion of the grounding terminal are disposed in the element receiving space, and the relay terminal includes a wire-side terminal connection portion for connection to the wire-side terminal, and an element connection portion for connection to the one terminal of the element.

In the invention having the above features, the circuit is formed by the relay terminal, the element and the grounding terminal. The element is connected to the element connection portions of the two terminals, that is, the relay terminal and the grounding terminal. The circuit has the above construction, and therefore can be produced without requiring any complicated production process. The wire-side terminal which is to be connected to the circuit is caused to project into the element receiving space through the terminal insertion hole, and then is connected to the wire-side terminal connection portion of the relay terminal.

(3) A structure of connecting a wire to an element-containing unit according to the invention may be characterized in that the internal resin cover, the relay terminal and the grounding terminal are mounted on either of the upper and lower resin covers by engagement, and the one and another terminals of the element are inserted into the element connection portions of the relay terminal and the grounding terminal, respectively.

In the invention having the above features, the internal resin cover is fitted relative to the upper and lower resin covers to be fixed thereto. The relay terminal and the grounding terminal are fitted relative to the upper and lower resin covers to be fixed thereto. On the other hand, the connection legs of the element are inserted respectively into the element connection portions of the relay terminal and grounding terminal, and are connected thereto. The element-containing unit can be assembled with the one-touch mounting operations without requiring any complicated production process.

(4) A structure of connecting a wire to an element-containing unit according to the invention may be characterized in that a wire reception portion for receiving the wire is formed on a side of the internal resin cover facing to the wire receiving space.

In the invention having the above feature, the intermediate portion of the wire, received in the wire receiving space, is positioned by the wire reception portion of the internal resin cover. The wire reception portion can be so shaped as to support the intermediate portion of the wire. The wire reception portion can be changed in shape so as to correspond to a desired wire diameter.

(5) A structure of connecting a wire to an element-containing unit according to the invention may be characterized in that an element holding portion for holding the element is formed on that side of the internal resin cover facing to the element receiving space.

In the invention having the above feature, the element, received in the element receiving space, is held by the element holding portion. The element is held between the internal resin cover and the upper and lower resin covers.

(6) A structure of connecting a wire to an element-containing unit according to the invention may be characterized in that the upper resin cover has a clamp for fixing the element-containing unit.

In the invention having the above feature, the element-containing unit is retainingly engaged with a mounting body such for example as a vehicle body through the clamp. Moreover, the installation of the wire is completed simultaneously when the element-containing unit is retainingly engaged with the mounting body. When the element-containing unit is retainingly engaged with the mounting body, there is achieved an advantage that the connection of the grounding terminal can be effected easily. The clamp is retaining means such as a retaining clamp. The invention does not exclude the case where the element-containing unit is fixed only by connecting the grounding terminal to the mounting body.

In the invention, there is achieved an advantage that damage and the separation of the element are prevented thanks to the provision of the internal resin cover.

In the invention, the circuit, including the element, can be formed into a simplified construction. Therefore, there is achieved an advantage that the production efficiency can be enhanced as compared with the conventional structure.

In the invention, the assembling of the element-containing unit can be effected with the one-touch operations. Therefore, there is achieved an advantage that the production efficiency can be enhanced as compared with the conventional structure.

In the invention, the intermediate portion of the wire, received in the element-containing unit, can be positioned by the wire reception portion. Therefore, there is achieved an advantage that the received condition of the wire can be made stable.

In the invention, the element, received in the element-containing unit, can be held by the element holding portion. Therefore, there is achieved an advantage that the received condition of the element can be made stable.

In the invention, the clamp is formed, and therefore the installation of the wire can be effected simultaneously when the element-containing unit is retainingly engaged with the mounting body. Therefore, there is achieved an advantage that the efficiency of the operation can be enhanced.

DETAILED DESCRIPTION OF THE PREFERRED EMBODIMENTS

The present invention will now be described with reference to the drawings.

Figure 1:
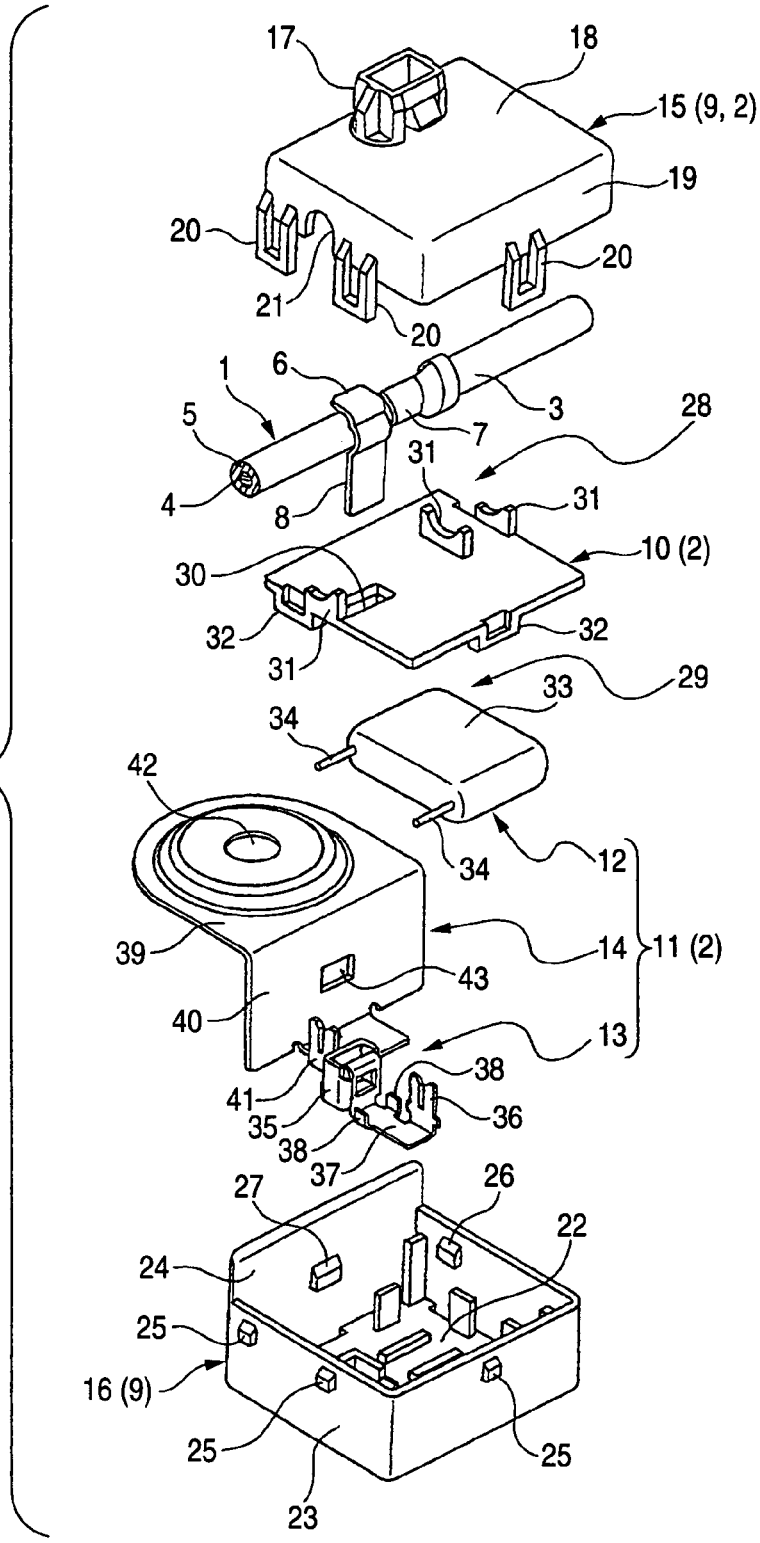
FIG. 1 is an exploded, perspective view showing one preferred embodiment of a structure of the invention for connecting a wire to an element-containing unit.
Figure 2:
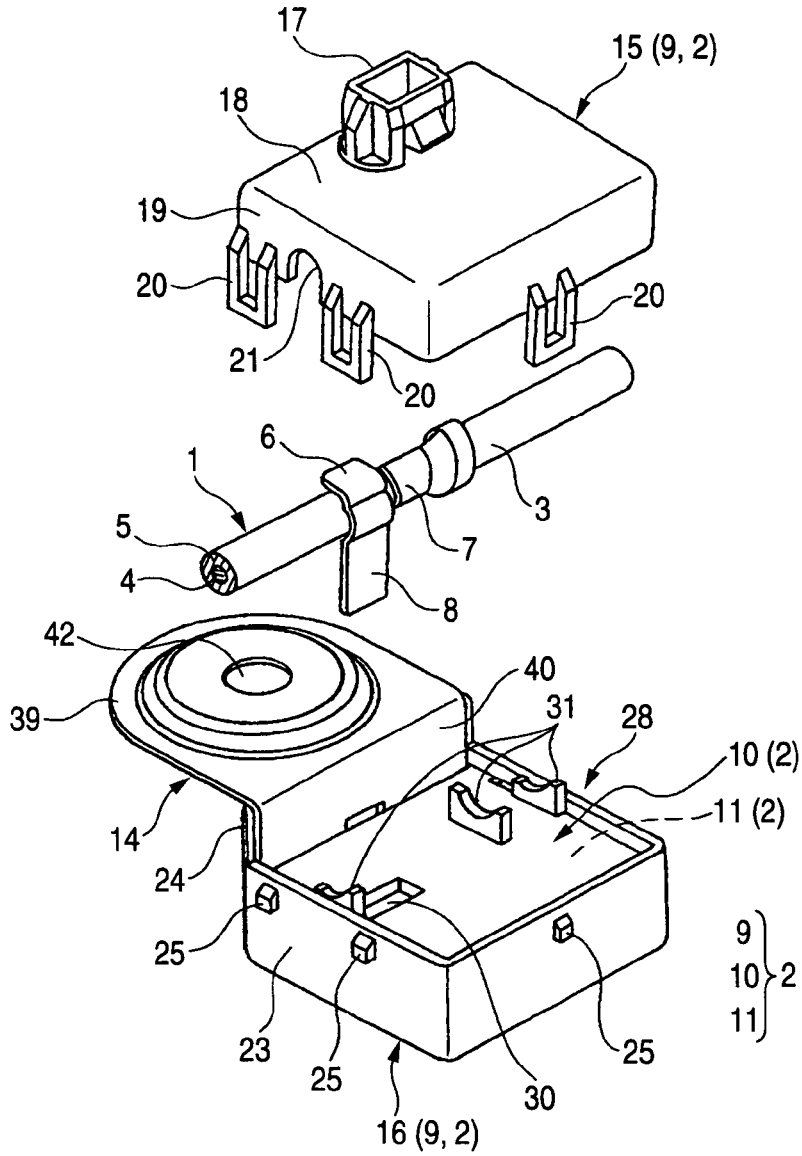
FIG. 2 is a perspective view, showing a condition before an intermediate portion of the wire is received in the unit.
Figure 3:
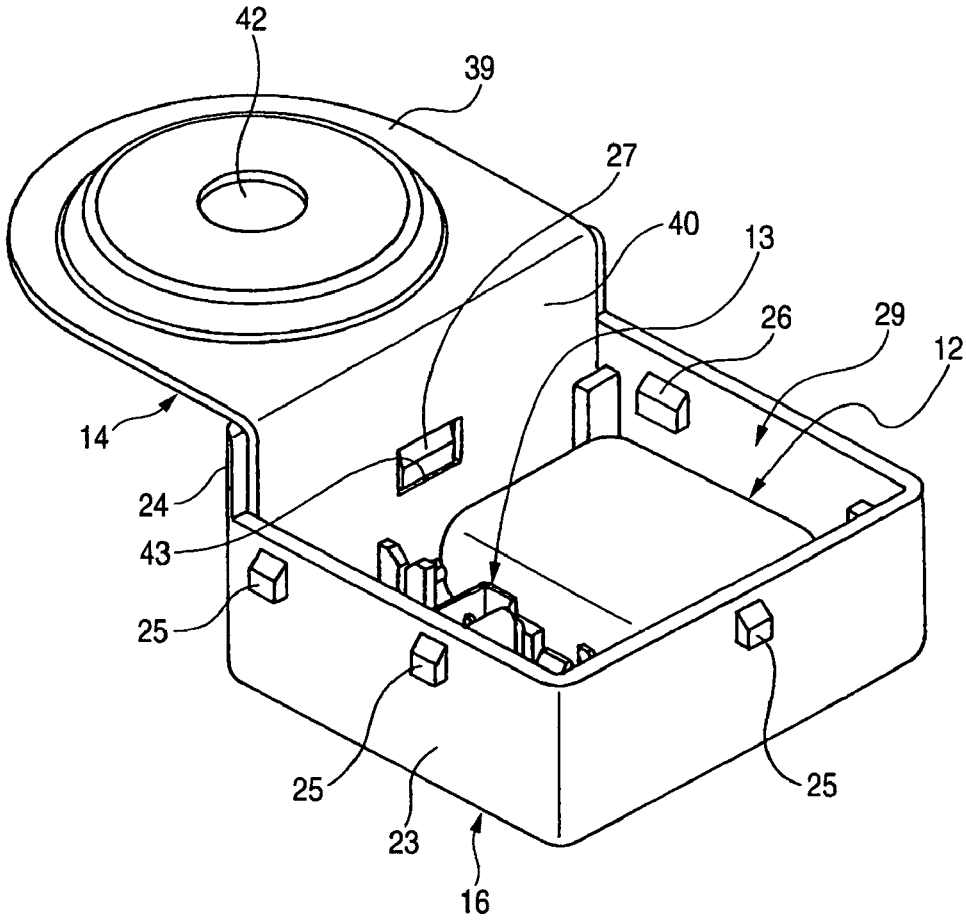
FIG. 3 is a perspective view, showing a condition in which the element is received in the unit.

FIG. 1 is an exploded, perspective view showing one preferred embodiment of a structure of the invention for connecting a wire to an element-containing unit, FIG. 2 is a perspective view, showing a condition before an intermediate portion of the wire is received in the unit, and FIG. 3 is a perspective view, showing a condition in which the element is received in the unit.

In FIG. 1, reference numeral 1 denotes the wire of the known type. Reference numeral 2 denotes the element-containing unit to be connected to the intermediate portion 3 of the wire 1. In this embodiment, the element-containing unit 2 is designed to function as a noise filter as will be hereafter more fully described (However, the unit 2 is not always limited to such a noise filter.). In the following description, the wire 1 is installed in a vehicle such as an automobile, and the element-containing unit 2 is retainingly engaged with a vehicle body. However, this is only one example, and the invention is not particularly limited to this embodiment. Namely, the connecting structure of the invention can be applied to other device than the vehicle.

The wire 1 is either one of a plurality of wires forming a wire harness or a single wire, and this wire 1 comprises a conductor 4, and an insulative sheath (or covering portion) 5 covering the conductor 4. A wire-side terminal 6 is electrically connected to the intermediate portion 3 of the wire 1. More specifically, the sheath 5 is removed from the intermediate portion 3 of the wire 1 over a predetermined length to thereby expose the conductor 4, and the wire-side terminal 6 is connected to the exposed conductor 4. The wire-side terminal 6 includes a conductor connection portion 7 for direct connection to the conductor 4, and a circuit connection portion 8 for connection to a circuit 11 (described later) in the element-containing unit 2.

The conductor connection portion 7 includes a portion for contact with the conductor 4, and another portion for being press-fastened on the sheath 5 although these are not particularly designated by reference numerals. The circuit connection portion 8 extends from the conductor connection portion 7. The circuit connection portion 8 is formed into a tab-like shape. The circuit connection portion 8 is arranged to extend in a direction perpendicular to a direction of extending of the wire 1. The circuit connection portion 8 need only to be connected to the circuit 11 (described later), and therefore its length is relatively small.

The element-containing unit 2 comprises an upper-lower resin cover 9, an internal resin cover 10, and the circuit 11. The circuit 11, though not particularly limited to any specified construction, includes the element 12, a relay terminal 13, and a grounding terminal 14. The upper-lower resin cover 9 comprises an upper resin cover 15 and a lower resin cover 16 both of which are molded of an insulative synthetic resin material. The upper and lower resin covers 15 and 16, when fitted together, jointly form a box-like member. The upper-lower resin cover 9 has a clamp 17 by which the assembled element-containing unit 2 can be retainingly engaged with the vehicle body in a fixed manner. In this embodiment, although the upper resin cover 15 and the lower resin cover 16 are separate from each other as shown in the drawings, the two covers 15 and 16 may be connected together by a hinge.

The upper resin cover 15 includes a top wall 18, and four peripheral (or side) walls 19 having the same height. A depth of the upper resin cover 15 from its open side is smaller than a depth of the lower resin cover 16. In this embodiment, the clamp 17 is formed integrally on an outer surface of the top wall 18 (The illustrated shape of the clamp 17 is given merely as one example.). A plurality of retaining portions 20 are formed on outer surfaces of the peripheral walls 19, and also two wire lead-out portions 21 (only one of which is shown) are formed in the peripheral walls 19. Each of the retaining portions 20 is formed into a generally U-shape, and can be elastically deformed outwardly. The retaining portions 20 are formed on three (19*b*) of the four peripheral walls 19. The wire lead-out portions 21 are formed respectively in the two opposed peripheral walls 19 disposed perpendicularly to the direction of extending of the wire 1. Each of the wire lead-out portions 21 is in the form of a U-shape notch groove having a size corresponding to the diameter of the wire 1.

The lower resin cover 16 includes a bottom wall 22, three peripheral walls 23 of the same height, and one peripheral wall 24 slightly higher than the other peripheral walls 23. A plurality of projections and ribs are formed on an inner surface of the bottom wall 22 although these portions are not particularly designated by reference numerals. These projections and ribs are so arranged that the constituent parts of the circuit 11 can be mounted on the lower resin cover 16 with a one-touch operation, that the constituent parts can be held in position and that the constituent parts can be insulated.

A plurality of retaining projections 25 are formed on outer surfaces of the three peripheral walls 23 of the same height, and the retaining portions 20 on the upper resin cover 15 can be retainingly engaged with these retaining projections 25, respectively. A plurality of retaining projections 26 are formed on inner surfaces of the three peripheral walls 23 of the same height, and retaining portions 32 (described later) on the internal resin cover 10 can be retainingly engaged with these retaining projections 26. A retaining projection 27 is formed on an inner surface of the slightly-higher peripheral wall 24, and a retaining portion 43 (described later) of the grounding terminal 14 can be retainingly engaged with this retaining projection 27.

The upper resin cover 15 and the lower resin cover 16 have the above fitting structure, and therefore can be connected together with a one-touch operation. Also, the lower resin cover 16 and the internal resin cover 10 are also so formed as to be combined together with a one-touch operation. Further, the constituent parts of the circuit 11 are so formed as to be mounted with one-touch operations. Therefore, it will be readily appreciated that the element-containing unit 2 has a good production efficiency.

The internal resin cover 10 is molded of an insulative synthetic resin material, and is so formed as to partition an internal space of the upper-lower resin cover 9 (which is formed by the upper and lower resin covers 15 and 16 fitted together) into a wire receiving space 28 and an element-receiving space 29. Namely, the internal resin cover 10 is formed into a generally plate-shape so as to separate the intermediate portion 3 of the wire 1 from the circuit 11. A terminal insertion hole 30 is formed through the internal resin cover 10, and the wire-side terminal 6 can be inserted from the wire receiving space 28 into the element-receiving space 29 through this terminal insertion hole 30. The terminal insertion hole 30 is so formed as to be disposed in registry with the relay terminal 13 of the circuit 11.

A plurality of wire reception portions 31 are formed on that side (or surface) of the internal resin cover 10 facing to the wire receiving space 28. The plurality of wire reception portions 31 and the terminal insertion hole 30 are arranged on a common straight line. Each wire reception portion 31 is in the form of a rib-like projection, and an arcuate recess, corresponding to the diameter of the wire 1, is formed in a distal end of the wire reception portion 31. The wire reception portions 31 serve to position the intermediate portion 3 of the wire 1. In the case where portions, similar to the wire reception portions 31, or portions for being pressed against the intermediate portion 3 of the wire 1 are formed on the inner surface of the top wall 18 of the upper resin cover 15, the intermediate portion 3 of the wire 1, received in the wire receiving space 28, can be firmly held.

An element holding portion (not shown) is formed on that side (or surface) of the internal resin cover 10 facing to the element receiving space 29. This element holding portion is held against the element 12 of the circuit 11, received in the element receiving space 29, to hold the element 12. For example, the element holding portion is formed by a mere flat surface or ribs.

The plurality of retaining portions 32 for retaining engagement with the respective retaining projections 26 (formed on the inner surface of the lower resin cover 16) are formed on three of four sides or edge portions (defining the peripheral edge) of the internal resin cover 10. Each retaining portion 32 is formed into a generally U-shape, and can be elastically deformed inwardly. That edge of the internal resin cover 10 where no retaining projection 26 exists is opposed to the slightly-higher peripheral wall 24 of the lower resin cover 16, with a predetermined gap formed therebetween. Part of the grounding terminal 14 is adapted to be snugly fitted in this predetermined gap.

As shown in the drawings, the element 12 includes a square cushion-like element body 33, and a pair of connection legs 34. In this embodiment, although a known capacitor is used as the element 12, any other suitable element such as a diode or a resistor can be used. The element 12 is held in such a condition that it will not be shaken by vibration of the vehicle and others as will hereinafter be described.

The relay terminal 13 serves to electrically connect the wire-side terminal 6 and the element 12 together, and this relay terminal 13 includes a wire-side terminal connection portion 35 of a female terminal shape for receiving the circuit connection portion 8 of the wire-side terminal 6, and an element connection portion 36 of a female receiving tab shape for receiving one connection leg 34 of the element 12. The wire-side terminal connection portion 35 and the element connection portion 36 are formed on and project upwardly from opposite end portions of a bus bar-like base plate portion 37, respectively. Reference numeral 38 denotes terminal holding portions which prevent the terminal from being disengaged from the fitting structure formed by the above-mentioned projections or ribs formed on the bottom surface 22 of the lower resin cover 16. Each of the terminal holding portions 38 is in the form of a relatively small tab-like projection, and is formed on and projects upwardly from a generally central portion of the base plate portion 37.

The grounding terminal 14 is adapted to be electrically connected to the vehicle body, and includes a grounding portion 39 for connection to the vehicle body, a cover-inner surface intimately-contacting portion 40 for intimate contact with the inner surface of the slightly-higher peripheral wall 24 of the lower resin cover 16, and an element connection portion 41 of a female receiving tab shape for receiving the other connection leg 34 of the element 12. The grounding portion 39 is so shaped as to be held in surface-to-surface contact with the vehicle body, and a through hole 42 is formed through a central portion of the grounding portion 39, and the grounding portion 39 can be fixed to the vehicle body by a screw passing through the through hole 42 into the vehicle body.

The cover-inner surface intimately-contacting portion 40 is in the form of a flat plate, and is disposed in continuous relation to the grounding portion 39 and the element connection portion 41. The cover-inner surface intimately-contacting portion 40 is disposed perpendicularly to the grounding portion 39 and the element connection portion 41. The retaining portion 43 for retaining engagement with the retaining projection 27 on the slightly-higher peripheral wall 24 is formed through a central portion of the cover-inner surface intimately-contacting portion 40.

As is the case with the element connection portion 36 of the relay terminal 13, the element connection portion 41 of the grounding terminal 14 is so disposed as to be fitted on the corresponding connection leg 34 of the element 12. The element connection portion 41 of the grounding terminal 14 and the element connection portion 36 of the relay terminal 13 are juxtaposed to each other, with the wire-side terminal connection portion 35 of the relay terminal 13 interposed therebetween.

Next, in the above construction, the mounting of the wire-side terminal 6 and the assembling of the element-containing unit 2 will be described.

With respect to the wire-side terminal 6 for the wire 1, first, the sheath 5 is removed from a desired section of the intermediate portion 3 of the wire 1 over a predetermined length to thereby expose the conductor 4. Then, the conductor connection portion 7 is connected to the exposed conductor 4. Thus, the mounting of the wire-side terminal 6 is completed.

With respect to the element-containing unit 2, first, the relay terminal 13 and the grounding terminal 14 are fitted respectively into predetermined portions of the lower resin cover 16 to be fixed to this lower resin cover 16. Then, the element 12 is connected to the fixed relay terminal 13 and ground terminal 14, thereby forming the circuit 11. Then, the internal resin cover 10 is fitted in the lower resin cover 16 to cover the circuit 11 in such a manner that the element 12 is held by the element holding portion (not shown). Then, the intermediate portion 3 of the wire 1 is put on the wire reception portions 31 of the internal resin cover 10, and also the circuit connection portion 8 of the wire-side terminal 6 is inserted into the terminal insertion hole 30 in the internal resin cover 10, thereby connecting the wire-side terminal 6 to the circuit 11. Finally, the upper resin cover 15 is fitted on the lower resin cover 16 in such a manner that the upper resin cover 15 covers the intermediate portion 3 of the wire 1. Thus, the assembling of the element-containing unit 2 is completed (The element-containing unit 2 is mounted at an arbitrary place so that this unit 2 can be suitably mounted on the vehicle.).

After the assembling operation is thus finished, the element-containing unit 2 is fixed to the vehicle body through the clamp 17 retainingly engaged with this vehicle body, and the grounding terminal 14 is screw-fastened to the vehicle body for grounding purposes, thus finishing the series of operations.

In the invention which has been described above with reference to FIGS. 1 to 3, the intermediate portion 3 of the wire 1 is received in the wire receiving space 28 in the upper-lower resin cover 9, and only the wire-side terminal 6, connected to the received wire 1, is inserted into the element receiving space 29 (in which the element 12 exists), and is connected to the circuit 11. Thanks to the provision of the internal resin cover 10, the intermediate portion 3 of the wire 1 is prevented from contacting the element 12.

In the invention, the circuit 11 is formed by the relay terminal 13, the element 12 and the grounding terminal 14. The element 12 is connected to the element connection portions 36 and 41 of the two terminals, that is, the relay terminal 13 and the grounding terminal 14. The circuit 11 has the above construction, and therefore can be produced without requiring any complicated production process. The wire-side terminal 6 which is to be connected to the circuit 11 is caused to project into the element receiving space 29 through the terminal insertion hole 30, and then is connected to the wire-side terminal connection portion 35 of the relay terminal 13. The distance between the wire 1 and the portion, functioning as the noise filter, is very small, and therefore good characteristics can be obtained.

In the invention, the internal resin cover 10 is fitted relative to the upper-lower resin cover 9 to be fixed thereto, and the relay terminal 13 and the grounding terminal 14 are fitted relative to the upper-lower resin cover 9 to be fixed thereto. The connection legs 34 of the element 12 are inserted respectively into the element connection portions 36 and 41 of the relay terminal 13 and grounding terminal 14, and are connected thereto. The element-containing unit 2 can be assembled with the one-touch mounting operations without requiring any complicated production process.

Furthermore, in the invention, the element-containing unit 2 is retainingly engaged with the vehicle body through the clamp 17, and at the same time the wire 1 is installed on the vehicle body.

Therefore, in the invention, damage and the separation of the element 12 can be prevented thanks to the provision of the internal resin cover 10. In the invention, the circuit 11 can be formed into the simplified construction, and therefore the production efficiency can be enhanced as compared with the conventional structure. Furthermore, in the invention, the assembling of the element-containing unit 2 can be effected with the one-touch operations, and therefore the production efficiency can be enhanced as compared with the conventional structure. Furthermore, in the invention, the intermediate portion 3 of the wire 1, received in the element-containing unit 2, can be positioned by the wire reception portions 31, and therefore the received condition of the wire 1 can be made stable. Furthermore, in the invention, the element 12, received in the element-containing unit 2, can be held by the element holding portion (not shown), and therefore the received condition of the element 12 can be made stable. Furthermore, in the invention, thanks to the formation of the clamp 17, the wire 1 can be installed simultaneously when the element-containing unit 2 is retainingly engaged with the vehicle body, and therefore the efficiency of the operation can be enhanced.

In the invention, various modifications can be made without departing from the subject matter of the invention.

For example, in the above embodiment, although the wire-side terminal 6 is provided, the invention is not limited to this construction, and can be modified into the following structure. Namely, in this modified structure, the formation of the wire-side connection terminal 35 at the relay terminal 13 is omitted, and instead a wire connection portion for projecting into the wire receiving space 28 through the terminal insertion hole 30 is formed at the relay terminal 13, and this wire connection portion is electrically connected to the wire 1 by press-contacting, press-clamping, welding or others. In this case, the provision of the wire-side terminal 6 is not necessary.

What is claimed is:

1. A structure of connecting a wire to an element-containing unit comprising:

a wire; and an element-containing unit including:

upper and lower insulative resin covers for covering an intermediate portion of said wire and an element, one terminal of which is electrically connected to a conductor of said wire, and another terminal of which is electrically connected to a grounding terminal;

an insulative internal resin cover provided to partition an internal space of said upper and lower resin covers into a wire receiving space in which said intermediate portion is located and an element receiving space in which said element is received; and a wire-side terminal provided on said intermediate portion of said wire so as to be electrically connected to said conductor of said wire, wherein said wire-side terminal is extended to said element receiving space to electrically connected to a circuit including said element through a terminal insertion hole formed in said internal resin cover.

2. A structure of connecting a wire to an element-containing unit according to claim 1, wherein a relay terminal for connecting said wire-side terminal and said element to form said circuit and an element connection portion of said grounding terminal are disposed in said element receiving space, and said relay terminal includes a wire-side terminal connection portion for connection to said wire-side terminal, and an element connection portion for connection to said one terminal of said element.

3. A structure of connecting a wire to an element-containing unit according to claim 2, wherein said internal resin cover, said relay terminal and said grounding terminal are mounted on either of said upper and lower resin covers by engagement, and said one and another terminals of said element are inserted into said element connection portions of said relay terminal and said grounding terminal, respectively.

4. A structure of connecting a wire to an element-containing unit according to claim 1, wherein a wire reception portion for receiving said wire is formed on a side of said internal resin cover facing to said wire receiving space.

5. A structure of connecting a wire to an element-containing unit according to claim 1, wherein an element holding portion for holding said element is formed on that side of said internal resin cover facing to said element receiving space.

6. A structure of connecting a wire to an element-containing unit according to claim 1, wherein said upper resin cover has a clamp for fixing said element-containing unit.

* * * * *